US006431845B1

(12) United States Patent
Thomas et al.

(10) Patent No.: US 6,431,845 B1
(45) Date of Patent: Aug. 13, 2002

(54) HEAD COVER ASSEMBLY WITH MONOLITHIC VALVE PLATE

(75) Inventors: Delbert L. Thomas, Watervaliet; Paul V. Foster, St. Joseph; Randy G. Godush, Stevensville, all of MI (US)

(73) Assignee: Gast Manufacturing, Inc., Benton Harbor, MI (US)

( * ) Notice: Subject to any disclaimer, the term of this patent is extended or adjusted under 35 U.S.C. 154(b) by 0 days.

(21) Appl. No.: 09/853,553

(22) Filed: May 11, 2001

Related U.S. Application Data

(60) Provisional application No. 60/210,627, filed on Jun. 9, 2000.

(51) Int. Cl.[7] ..... F04B 39/10

(52) U.S. Cl. ..... 417/571; 417/423.14; 417/415; 417/521

(58) Field of Search ..... 417/571, 423.14, 417/415, 521

(56) References Cited

U.S. PATENT DOCUMENTS

| | | | |
|---|---|---|---|
| 498,989 | A | 6/1893 | Perry |
| 1,029,726 | A | 6/1912 | Sprado |
| 1,636,001 | A | 7/1927 | Kasley |
| 1,661,148 | A | 2/1928 | Winkler |
| 1,672,436 | A | 6/1928 | Thege |
| 1,896,098 | A | 2/1933 | Poyer |
| 1,896,404 | A | 2/1933 | Hale |
| 1,951,558 | A | 3/1934 | Nystrom |
| 2,084,665 | A | 6/1937 | Aikman |
| 2,127,825 | A | 8/1938 | Mader |
| 2,134,077 | A | 10/1938 | Ehret |
| 2,673,130 | A | 3/1954 | Becker |
| 2,765,779 | A | 10/1956 | Graves |
| 2,766,695 | A | 10/1956 | Gailloud |
| 2,851,020 | A | 9/1958 | Gailloud |
| 2,879,913 | A | 3/1959 | McCombie |

(List continued on next page.)

FOREIGN PATENT DOCUMENTS

| | | |
|---|---|---|
| DE | 101233 | 9/1896 |
| DE | 581380 | 7/1933 |
| DE | 844998 | 8/1960 |
| FR | 2 323 035 | 11/1975 |
| GB | 406000 | 2/1934 |
| IT | 313250 | 12/1933 |

OTHER PUBLICATIONS

Vacuum and Pressure Systems Handbook, Revised Edition, Copyright 1986 by Gast Manufacturing Corporation, pp. 22 and 23.

(List continued on next page.)

*Primary Examiner*—Charles G. Freay
*Assistant Examiner*—Michael K. Gray
(74) *Attorney, Agent, or Firm*—Barnes & Thornburg

(57) ABSTRACT

A head cover assembly for a two cylinder compressor is described. The head cover assembly is mounted over the compressor cylinders and includes a one piece valve plate with a pair of removable heads. The valve plate includes two substantially identical cylinder covers disposed over a pair of plate sections, thereby enclosing a volume above each plate section with a head installed. Each cylinder cover includes a divider wall which divides the enclosed volume of the cover into an intake volume and an exhaust volume. A pair of passageways provides communication between the cylinder covers connecting the exhaust volumes and the intake volumes.

22 Claims, 9 Drawing Sheets

U.S. PATENT DOCUMENTS

| | | | |
|---|---|---|---|
| 2,970,608 | A | 2/1961 | Doeg |
| 2,976,813 | A | 3/1961 | Redman |
| 2,985,358 | A | 5/1961 | Lee et al. |
| 3,049,284 | A | 8/1962 | Alamprese |
| 3,082,935 | A | 3/1963 | Arak |
| 3,139,009 | A | 6/1964 | Härting |
| 3,160,229 | A | 12/1964 | Terasawa |
| 3,209,659 | A | 10/1965 | Colwell |
| 3,277,837 | A | 10/1966 | Pangburn |
| 3,315,651 | A | 4/1967 | Dangauthier |
| 3,375,972 | A | 4/1968 | Raufeisen |
| 3,386,424 | A | 6/1968 | Appeman |
| 3,432,177 | A | 3/1969 | Colwell |
| 3,468,260 | A | 9/1969 | Belden |
| 3,472,446 | A | 10/1969 | Linnert |
| 3,521,607 | A | 7/1970 | Wiseman et al. |
| 3,526,469 | A | 9/1970 | Lipe et al. |
| 3,568,573 | A | 3/1971 | Bailey et al. |
| 3,612,726 | A | 10/1971 | Yowell |
| 3,628,427 | A | 12/1971 | Bailey |
| 3,718,410 | A | 2/1973 | Berger et al. |
| 3,841,796 | A | 10/1974 | Schlanzky |
| 3,882,842 | A | 5/1975 | Bailey et al. |
| 3,927,956 | A | 12/1975 | Linthicum |
| 3,961,868 | A | 6/1976 | Droege, Sr. et al. |
| 3,961,869 | A | 6/1976 | Droege, Sr. et al. |
| 3,981,631 | A | 9/1976 | Kemp |
| 3,998,571 | A | 12/1976 | Falke |
| D245,779 | S | 9/1977 | Nobata |
| 4,088,428 | A | 5/1978 | Bannister et al. |
| D250,113 | S | 10/1978 | Nobata |
| 4,123,201 | A | 10/1978 | Andriulis |
| 4,275,999 | A | 6/1981 | Hetzel et al. |
| 4,311,440 | A | 1/1982 | Eberhardt |
| 4,406,590 | A | 9/1983 | Kessler |
| 4,433,966 | A | 2/1984 | Krumm |
| 4,434,448 | A | 2/1984 | Bell et al. |
| 4,477,231 | A | 10/1984 | Swift |
| 4,480,368 | A | 11/1984 | Vachon |
| 4,559,686 | A | 12/1985 | Kessler |
| 4,594,760 | A | 6/1986 | Dillard |
| 4,642,037 | A | 2/1987 | Fritchman |
| 4,718,827 | A | 1/1988 | Sutton et al. |
| 4,749,340 | A | 6/1988 | Ikeda et al. |
| 4,781,540 | A | 11/1988 | Ikeda et al. |
| 4,782,738 | A | 11/1988 | Jackson et al. |
| 4,790,727 | A | 12/1988 | Steele |
| 4,810,174 | A | 3/1989 | Stuckey et al. |
| 4,842,498 | A | 6/1989 | Bramstedt et al. |
| 4,867,650 | A | 9/1989 | Ikeda et al. |
| 4,911,614 | A | 3/1990 | Kawai et al. |
| 4,976,284 | A | 12/1990 | Hovarter |
| 4,995,795 | A | 2/1991 | Hetzel et al. |
| 5,064,359 | A | 11/1991 | Plummer |
| 5,096,395 | A | 3/1992 | Todescat et al. |
| 5,145,335 | A | 9/1992 | Abelen et al. |
| 5,147,190 | A | 9/1992 | Hovarter |
| 5,156,532 | A | 10/1992 | Arndt et al. |
| 5,213,125 | A | 5/1993 | Leu |
| 5,226,803 | A | 7/1993 | Martin |
| 5,231,917 | A | 8/1993 | Wood |
| 5,288,212 | A | 2/1994 | Lee |
| 5,328,338 | A | 7/1994 | Hirano et al. |
| 5,370,156 | A | 12/1994 | Peracchio et al. |
| 5,379,799 | A | 1/1995 | Kawai et al. |
| 5,390,633 | A | 2/1995 | Taue |
| 5,396,930 | A | 3/1995 | Ebbing et al. |
| 5,421,368 | A | 6/1995 | Maalouf et al. |
| 5,454,397 | A | 10/1995 | Miszczak |
| 5,456,287 | A | 10/1995 | Leu |
| 5,586,874 | A | 12/1996 | Hashimoto et al. |
| 5,601,118 | A | 2/1997 | Jang |
| 5,603,611 | A | 2/1997 | Tarutani et al. |
| 5,632,607 | A | 5/1997 | Popescu et al. |
| 5,632,609 | A | 5/1997 | Hashimoto |
| D379,996 | S | 6/1997 | Leu et al. |
| 5,647,395 | A | 7/1997 | Hashimoto et al. |
| 5,655,898 | A | 8/1997 | Hashimoto et al. |
| 5,895,208 | A | 4/1999 | Riedlinger et al. |
| 6,056,521 | A | 5/2000 | Leu et al. |
| 6,126,410 | A | 10/2000 | Faulkner et al. |

OTHER PUBLICATIONS

Advertising literature: New Gast ROC–R Compressor.

Advertising literature: Gast Air Compressors, vol. F–10, dated May, 1992, p. 41.

Advertising literature: Healy Systems, Inc., The New VP 500 Central Vacuum Vane Pump, Nov. 16, 1993.

Untitled drawing of pump, Models 607CB22 and 607CD22.

Thomas Industries, Inc. 2619/2621 Series Compressors and Vacuum Pumps, pamphlet, published Jul. 1994.

Thomas Compressors and Vacuum Pumps, 2750 Series, pamphlet, published Jul. 1995.

Thomas Industries, Inc. Compressors and Vacuum Pumps, Series 2600, pamphlet, published Jun. 1994.

Thomas Industries, Inc. Compressors and Vacuum Pumps, 2807 Series, pamphlet, published Jun. 1994.

HEAD COVER ASSEMBLY WITH MONOLITHIC VALVE PLATE

RELATED APPLICATION

This application claims the priority of U.S. Provisional Patent Application No. 60/210,627 filed on Jun. 9, 2000, the complete disclosure of which is hereby expressly incorporated by reference.

FIELD OF THE INVENTION

This invention relates generally to head cover assemblies for compressors, and more specifically to head cover assemblies for multiple cylinder compressors.

BACKGROUND OF THE INVENTION

Dual cylinder, reciprocating compressors generally include a pair of pistons which reciprocate within a pair of cylinders, a pair of valve plates, and a pair of cylinder heads or a single piece cylinder head assembly. Each cylinder head includes an enclosed intake volume and exhaust volume. The gas or air is valved into and out of the compressor cylinders from the enclosed intake volumes in communication with the compressor inlet, to the enclosed exhaust volumes in communication with the compressor outlet.

SUMMARY OF THE INVENTION

The present invention provides a head cover assembly for a two cylinder compressor mounted over the compressor cylinders. Such a two cylinder compressor is disclosed in U.S. Pat. No. 6,126,410, which is hereby expressly incorporated by reference. The head cover assembly includes a one piece valve plate with a pair of removable heads. The valve plate includes two substantially identical cylinder covers disposed over a pair of plate sections, thereby enclosing a volume above each plate section with the head installed. Each cylinder cover includes a divider wall which divides the enclosed volume of the cover into an intake volume and an exhaust volume. The exhaust volumes of each cylinder cover are in communication with one another through a passageway in the center portion of the valve plate connecting the two cylinder covers. The intake volumes are similarly communicated through a passageway in the center portion. The intake volume enclosed by each cylinder cover is in communication with an inlet port for drawing air into the compressor. The exhaust volume of each cylinder cover is in communication with an exhaust port for expelling air from the compressor.

Each plate section includes a first side, a second side, a first bore, and a second bore. A first valve is connected to the first side of the plate section for controlling flow into the cylinder through the first bore, and a second valve is connected to the second side of the plate section for controlling flow out of the cylinder through the second bore.

As the piston travels through its downstroke, air is drawn into the inlet volume through the inlet port, and into the cylinder through the second valve. As the piston travels through its upstroke, air within the cylinder is passed through the second valve and into the exhaust volume. The air passes from the exhaust volume out of the head cover assembly through the exhaust port.

One embodiment of the present invention provides a multiple cylinder pump. The pump includes at least two separate cylinder housings, a pair of pistons, a one piece valve plate, and a pair of heads for the valve plate. Each cylinder housing defines a cylinder with an axis. The axes are parallel and spaced apart. Each piston is reciprocable in a corresponding one of the cylinders. The one piece valve plate includes a plate section for each of the cylinder housings.

In another embodiment of the pump, the valve plate includes with each plate section a chamber portion having an intake volume and an exhaust volume with a divider wall between the intake volume and the exhaust volume. In certain embodiments, the divider wall is straight.

In yet another embodiment of the pump, the valve plate includes a center portion which fluidly connects the corresponding intake volumes and exhaust volumes.

In still another embodiment, the pump further comprises at least one gasket between the cylinder housings and the valve plate.

In yet another embodiment, the pump further comprises a gasket for each head to seal the head to the valve plate.

The present invention further provides an embodiment of a head cover assembly for a pump having multiple cylinders. The head cover assembly includes a one piece valve plate including a plate section for at least two of the cylinders of the pump and at least one head for the valve plate.

In another embodiment of the head cover assembly, the valve plate includes with each plate section a chamber portion having an intake volume and an exhaust volume.

In certain embodiments of the head cover assembly, the valve plate is a die cast aluminum alloy.

In yet another embodiment of the head cover assembly, each plate section includes a pair of valves.

In still another embodiment of the head cover assembly, the valve plate includes a center portion which fluidly connects the plate sections The present invention still further provides a head cover assembly for a pump having at least two separate cylinders. The assembly including a plate section for each of the cylinders, the plate sections being formed together in a single piece of continuous material.

In yet another embodiment of the head cover assembly, each plate section includes a continuous side wall extending substantially perpendicular around the perimeter of the valve place and a divider wall extending substantially perpendicular from the plate section and spanning the side wall providing an intake chamber and an exhaust chamber. The assembly further comprises a head for each plate section.

In yet still another embodiment of the head cover assembly, the assembly further comprises a gasket for sealing each head to the top of the side wall and divider wall. In certain embodiments of the head cover assembly, the assembly further comprises a plurality of fasteners to attach the plate sections and heads to the pump.

In yet another embodiment of the head cover assembly, the assembly further comprises a first tube fluidly connecting the intake chambers of the plate sections and a second tube fluidly connecting the exhaust chambers of the plate sections.

In still another embodiment of the head cover assembly, the assembly further comprises a gasket for sealing each plate section to the corresponding cylinder.

Other features of the present invention will become apparent upon consideration of the following description of exemplary embodiments and the accompanying drawings.

BRIEF DESCRIPTION OF THE DRAWINGS

The present invention will be described hereafter with reference to the attached drawings which are given as non-limiting examples only, in which.

These exemplifications set out herein illustrate an embodiment of the invention that is not to be construed as limiting the scope of the invention in any manner.

DESCRIPTION OF EMBODIMENTS OF THE INVENTION

The embodiments described herein are not intended to be exhaustive or to limit the invention to the precise forms disclosed.

Figure 1:
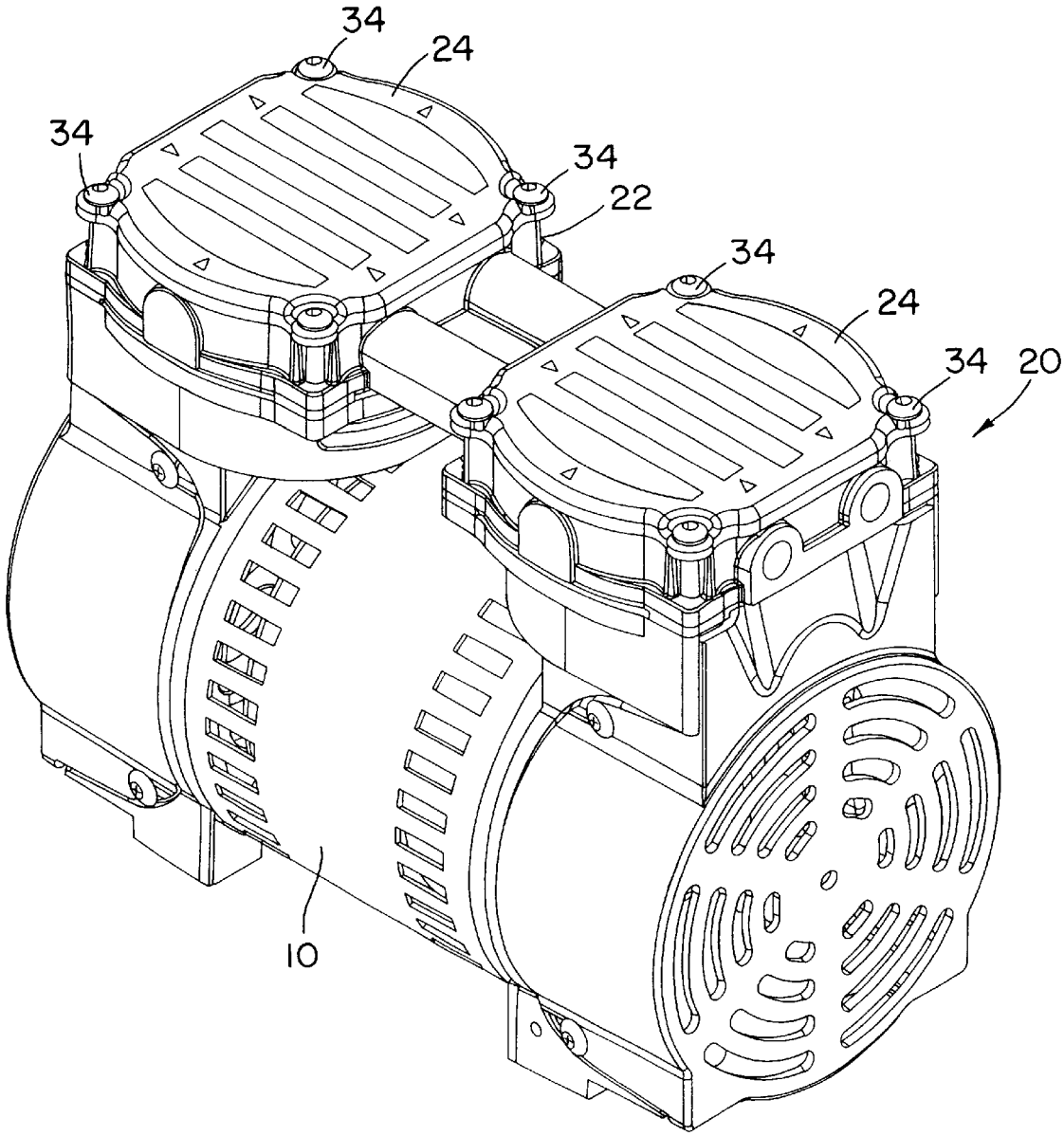
FIG. 1 is a perspective view of the inventive head cover assembly attached to a dual cylinder compressor.

FIG. 1 shows a head cover assembly 20 according to the present invention mounted to a compressor 10. Compressor 10 may be of various, conventional configurations having at least two cylinders. Compressor 10 of FIG. 1 is a dual cylinder configuration, each cylinder having substantially identical structure and performing a substantially identical function. Head cover assembly 20 similarly includes one piece valve plate 22 and a pair of heads 24. Fasteners 34 secure valve plate 22 and heads 24 to compressor 10.

Figure 2:
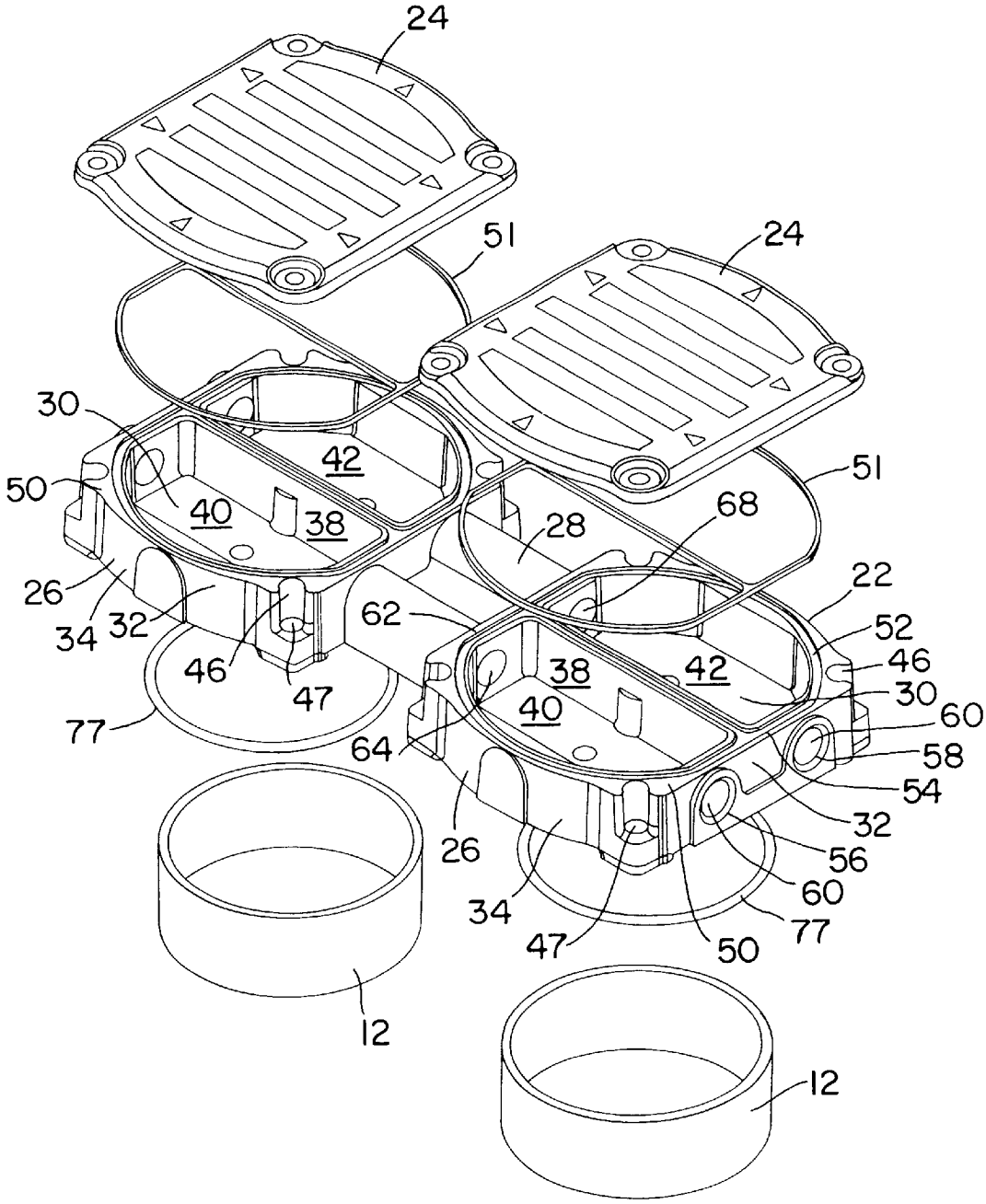
FIG. 2 is an exploded perspective view of head cover assembly of FIG. 1 including a one piece valve plate and a pair of heads.

FIG. 2 shows head cover assembly 20 of the present invention disassembled from compressor 10. Head cover assembly 20 generally includes a one piece valve plate 22 and a pair of heads 24. One piece valve plate 22 is made of a die cast aluminum alloy or other suitable material and includes two substantially identical sections 26 connected by center portion 28. Each section 26 includes a plate section 30 and a chamber portion 32.

Thus, except where indicated, for example, in the description of the center portion 28 which connects the chamber portions 32, the remainder of this description will address only the structure and function of one-half of head cover assembly 20.

Referring now to FIGS. 2–9, it is shown that the head cover component of the present invention generally includes a pair of sections 26, which are joined together by a center portion 28, and a pair of heads 24. As previously mentioned, since both sections 26 are identical, only one will be described in detail. Each section 26 includes plate section 30 and chamber portion 32 which is disposed upon plate section 30. Each chamber portion 32 includes a continuous side wall 34 extending from plate section 30 and a divider wall 38 which is disposed within the enclosed volume of side wall 34, plate section 30, and head 24. Divider wall 38 divides the enclosed volume into an intake volume 40 and an exhaust volume 42.

Chamber portion 32 includes four corner portions 44, each having a mounting indentation 46 and hole 47 which register with a corresponding mounting hole 48 in head 24. The upper surface 50 of chamber portion 32, which extends around the perimeter of chamber portion 32 and atop divider wall 38, compressively engages a gasket 51 when head 24 is mounted to chamber portion 32. As such, gasket 51 is compressed into groove 52 to provide a seal between chamber portion 32 and head 24 along the gasket.

Side wall 34 is integrally formed with plate section 30 at a substantially perpendicular intersection, thereby maximizing the interior volume enclosed by head 24. Integrally formed on flat portion 54 of side wall 34 is a first, inlet port 56 and a second, exhaust port 58. Each port has a substantially cylindrical inner wall 60 with threads formed thereon (not shown). Directly across from first, inlet port 56 formed on flat portion 62 of side wall 34 is a first opening 64 which is in communication with a first passageway 66 extending through center portion 28 into the other chamber portion 32. Similarly, directly across from second, exhaust port 58 on flat portion 62 is a second opening 68 which is in communication with a second passageway 70 extending through center portion 28 into the other chamber portion 32. Ports 56 and 58 function as receptacles for connection with the external apparatus used in conjunction with compressor 10. Since passageways 66 and 70 communicate the enclosed volumes of chamber portions 32, the operator may connect external apparatus to the ports 56 and 58 of either or both chamber portions 32.

Each plate section 30 is a flat, substantially rectangular plate extending from the lower edge of chamber portion 32 having a first side 72 directed toward the cylinder of compressor 10 and a second side 74 directed toward head 24. First side 72 includes a circular groove 75, shown in FIG. 3, for receiving a gasket 77 which engages the upper edge of cylinder 12 of compressor 10.

Figure 4:
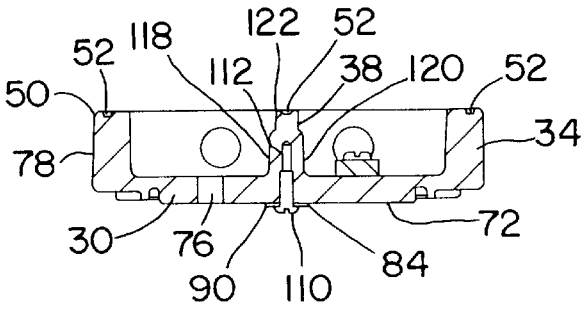
FIG. 4 is a cross-sectional view of the valve plate of FIG. 3 along line 4—4.
Figure 3:
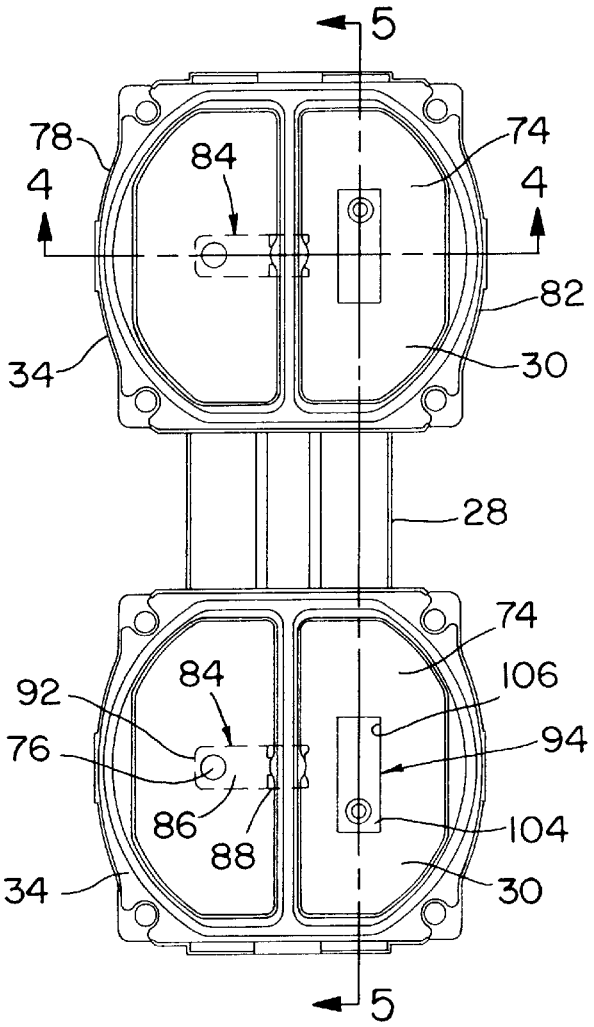
FIG. 3 is a top view of the valve plate with the valves attached.
Figure 5:
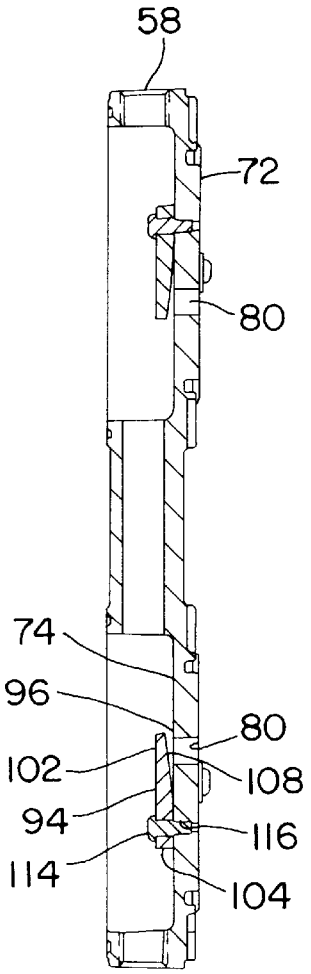
FIG. 5 is a cross-sectional view of the valve plate of FIG. 3 along line 5—5.
Figure 6:
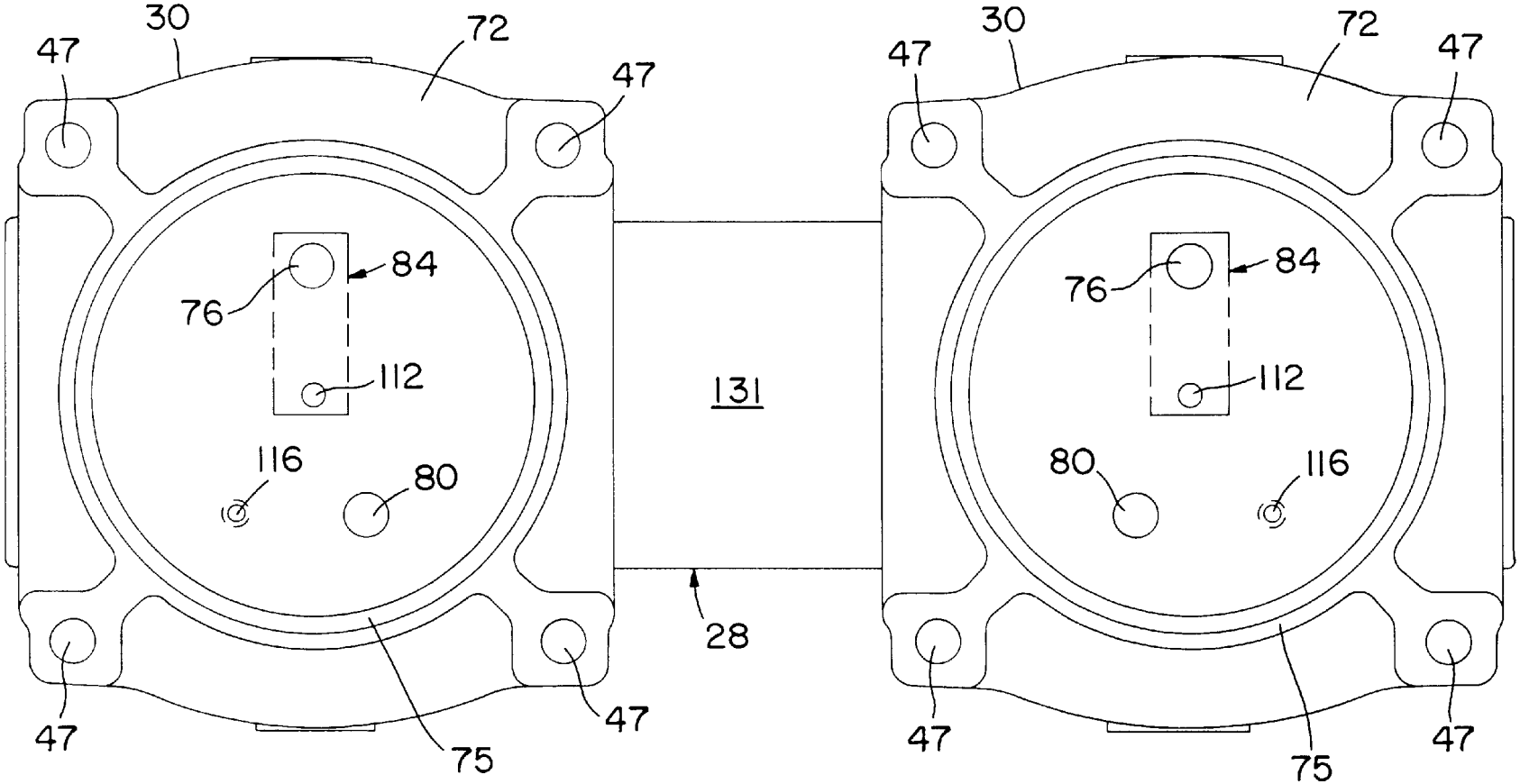
FIG. 6 is a bottom view of the valve plate.
Figure 7:
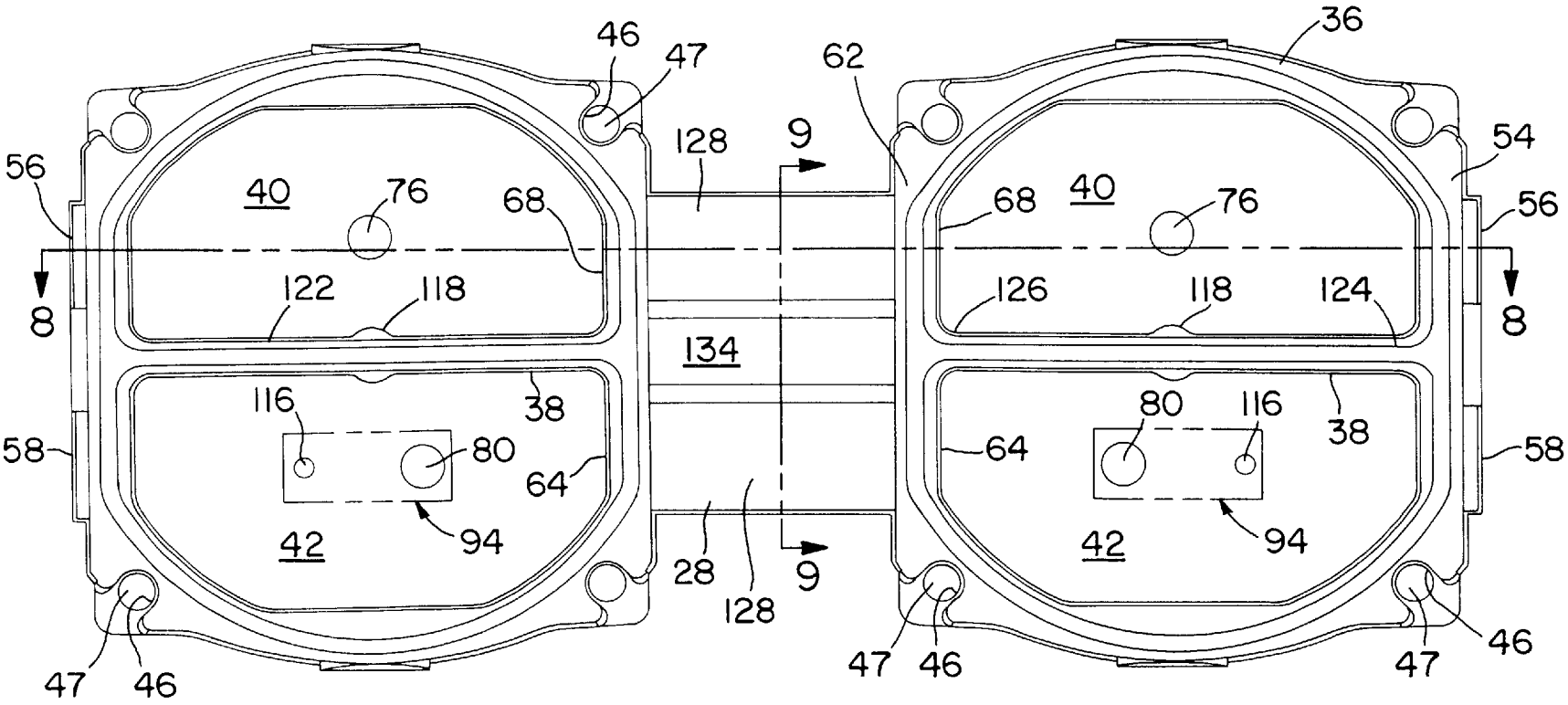
FIG. 7 is a top view of the valve plate.
Figure 8:
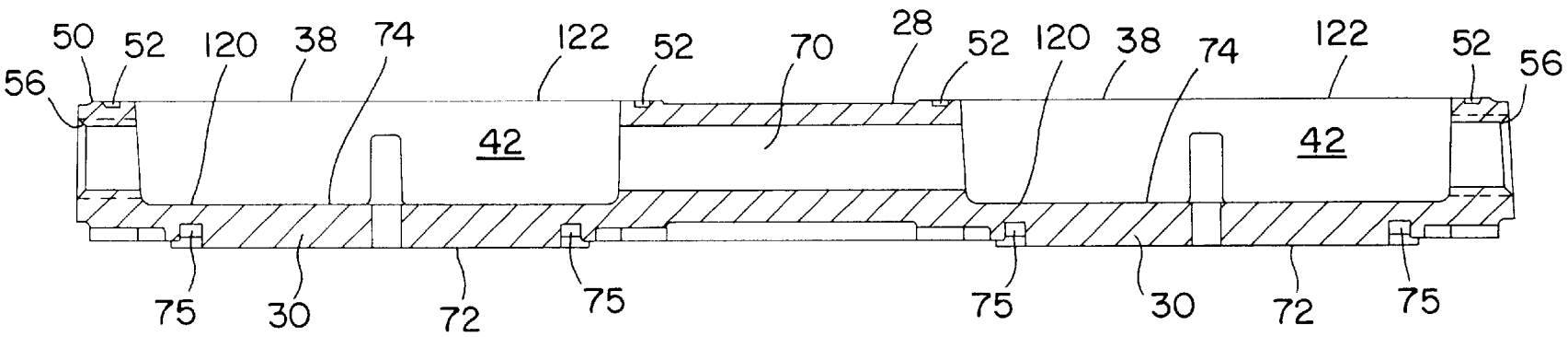
FIG. 8 is a cross-sectional view of the valve plate of FIG. 7 along line 8—8.
Figure 9:
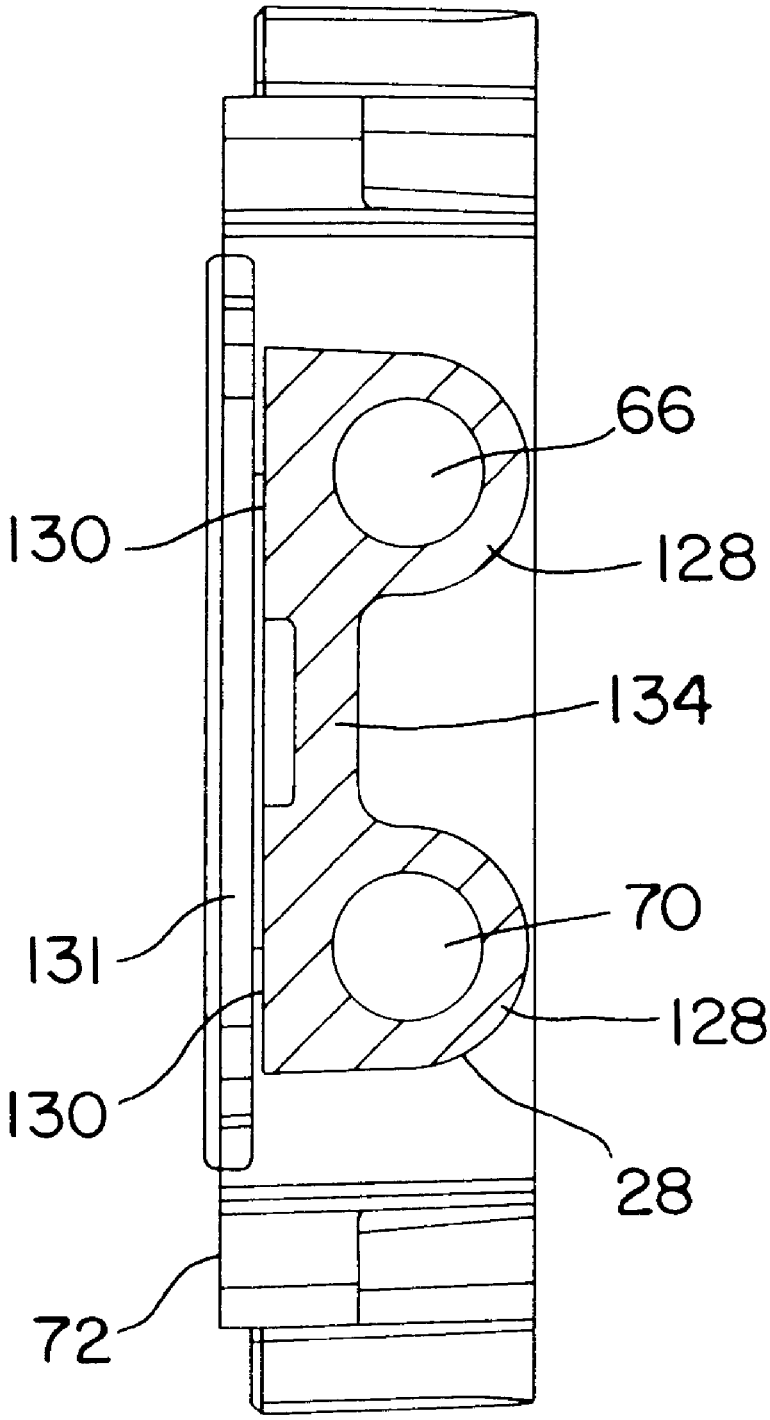
FIG. 9 is a cross-sectional view of the valve plate of FIG. 7 along line 9—9.

Referring now to FIGS. 3 through 5, a first bore 76 extends through plate section 30 adjacent one edge 78 of plate section 30 and a second bore 80 extends through plate section 30 adjacent the other edge 82. A first valve 84 (shown in dotted lines in FIG. 3) is mounted to first side 72 of plate section 30. First valve 84 includes a flexible sheet 86 having one end 88 fixedly attached to first side 72, headtured between a retainer plate 90 and first side 72, and another, free end 92 which extends over and substantially covers first bore 76. A second valve, generally designated 94, is attached to second side 74 of plate section 30. Second valve 94 also includes a flexible sheet 96 having one end 98 fixedly attached to second side 74 of plate section 30, and another, free end 100 which extends over and substantially covers second bore 80. Second valve 94 further includes a valve limiter 102 which has one end 104 fixedly attached to plate section 30 and another end 106. Flexible sheet 96 is headtured between valve limiter 102 and second side 74 of plate section 30. Limiter 102 includes an inclined or curved surface 108 which diverges from second side 74 with distance from one end 104. Accordingly, as flexible sheet 96 flexes away from second side 74, surface 108 engages sheet 96 to limit the distance away from second side 74 that flexible sheet 96 may travel.

First valve 84 is attached to plate section 30 by fastener 110 at threaded hole 112 in enlarged portion 118 of divider wall 38. Fastener 110 is shown as a threaded screw which extends through retainer plate 90 and flexible sheet 86 and threads into hole 112. Second valve 64 is attached to plate section 30 by fastener 114 at threaded hole 116. Fastener 114 is shown as a threaded screw which extends through limiter 102 and flexible sheet 66 into hole 116. However, fastener 114 may be of various configurations, for example, a rivet or a nut and bolt combination.

Referring now to FIGS. 6 through 9, divider wall 38 extends between side wall 34 to divide the enclosed volume of chamber portion 32 into intake volume 40 and exhaust volume 42 as described above. Lower edge 120 of divider wall 38 is integrally connected to plate section 30. Upper edge 122 of divider wall 38 lies in substantially the same plane as surface 50 of chamber portion 32. Accordingly, as surface 50 engages the outer ring of gasket 51 when head 24 is mounted to chamber portion 32, head 24 compresses the portion of the gasket extending between the outer ring into groove 52 on upper edge 122 of divider wall 38, thereby providing a seal between intake volume 40 and exhaust volume 42.

Divider wall 38 includes one end 124 connected to flat portion 54 of side wall 36 and another end 126 connected to the opposed, flat portion 62 of side wall 36. Divider wall 38 extends into the interior space of chamber portion 32 in perpendicular relationship to flat portions 54 and 62 of sidewall 36.

Center portion 28 extends between and connects the two chamber portions 32. As mentioned, center portion 28 includes first passageway 66 and second passageway 70. The passageways are defined within a pair of tubular members 128. Each tubular member 128 has a flat lower surface 130 which is recessed relative to side 72 of plate section 30. A web 134 extends between tubular members 128. A plate 131 attaches to lower surfaces 130 providing a surface to identify the valve plate.

It should be apparent that divider wall 38 can be positioned within chamber portion 32 between ports 56, 58 and openings 64, 68 to adjust the size of intake volume 40 or exhaust volume 42.

Figure 10:
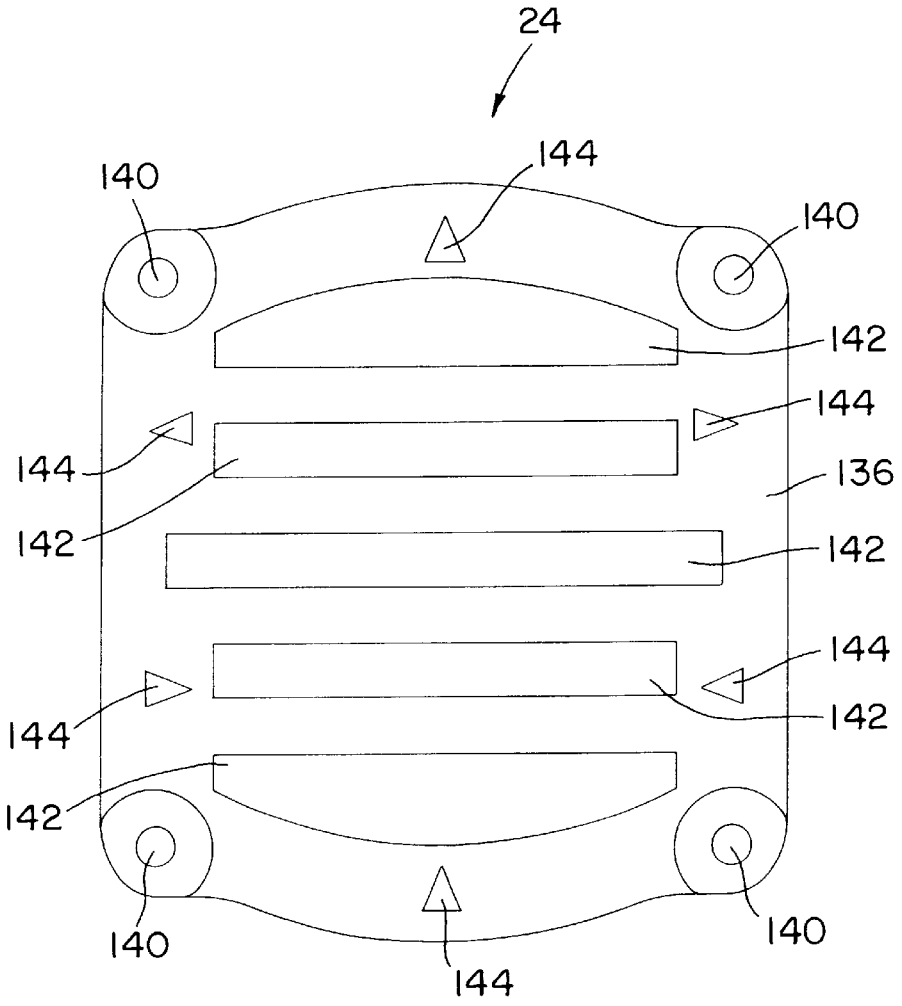
FIG. 10 is a top view of the head.
Figure 11:
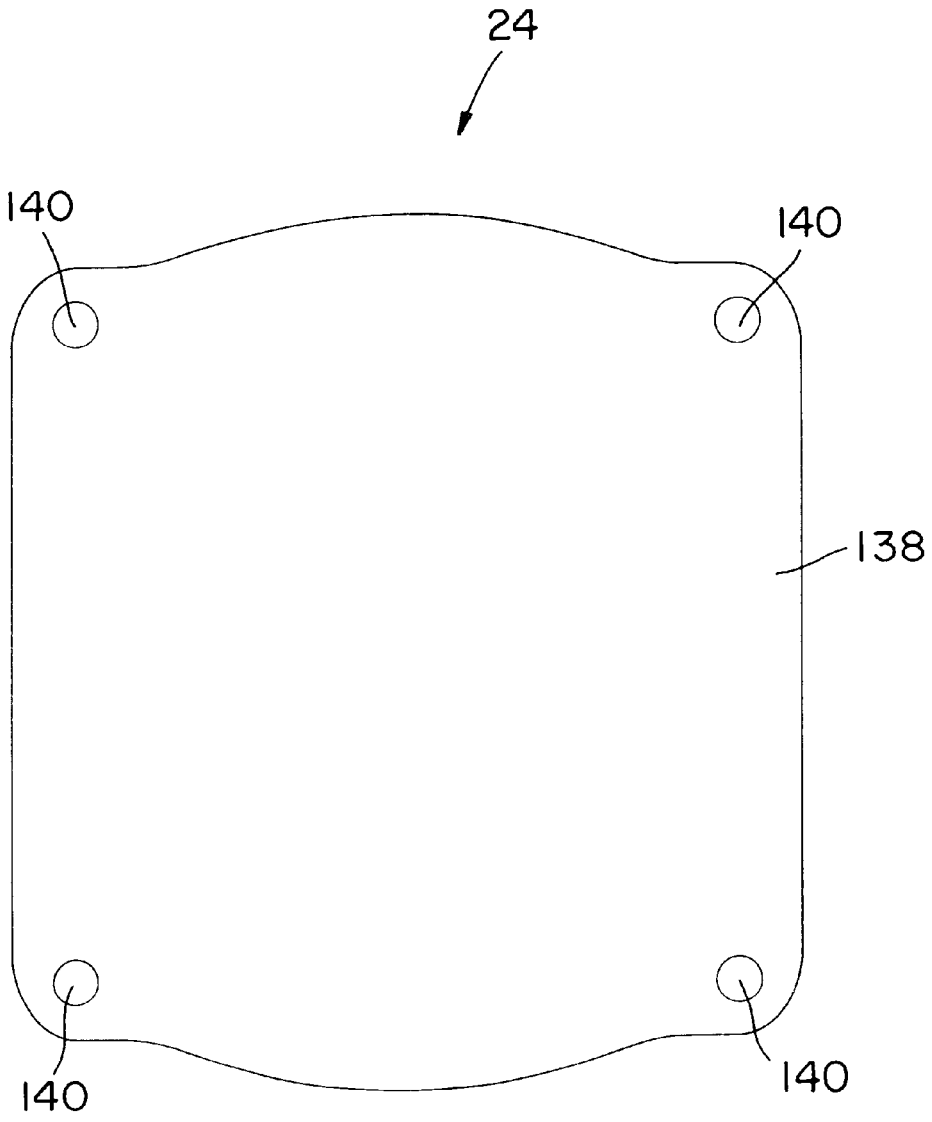
FIG. 11 is a bottom view of the head.

Referring now to FIGS. 10 and 11, each of heads 24 is a substantially rectangular plate made of a die cast aluminum alloy or other suitable material and includes a top side 136, a bottom side 138, and four mounting holes 140. Top side 136 includes a plurality of raised strips 142 to improve both the strength and appearance of the head and plurality of raised arrows 144 to show the direction of the air into head cover assembly 20. Bottom side 138 is substantially flat to facilitate a good seal between valve plate 22 and head 24.

While this invention has been described as having exemplary embodiments, this application is intended to cover any variations, uses, or adaptions using its general principles. Further, this application is intended to cover such departures from the present disclosure as come within the known or customary practice within the art to which it pertains. The spirit and scope of the invention are to be limited only by the terms of the appended claims.

What is claimed is:

1. A pump comprising:

at least two separate cylinder housings, each cylinder housing defining a cylinder with an axis, the axes being parallel and spaced apart;

a pair of pistons, each piston being reciprocable in a corresponding one of the cylinders;

a one piece valve plate including a plate section for each of the cylinder housings; and a pair of heads for the valve plate;

wherein the valve plate includes with each plate section a chamber portion having an intake volume and an exhaust volume; and wherein the valve plate includes a center portion which fluidly connects the plate sections.

2. The pump of claim 1, wherein the valve plate includes a divider wall between the intake volume and the exhaust volume.

3. The pump of claim 2, wherein the divider wall is straight.

4. The pump of claim 1, further comprising at least one gasket between the cylinder housings and the valve plate.

5. The pump of claim 1, further comprising a gasket for each head to seal the head to the valve plate.

6. A head cover assembly for a pump having multiple cylinders, comprising:

a one piece valve plate including a plate section for at least two of the cylinders of the pump; and at least one head for the valve plate;

wherein the valve plate includes a center portion which fluidly connects the plate sections.

7. The head cover assembly of claim 6, wherein the valve plate includes with each plate section a chamber portion having an intake volume and an exhaust volume.

8. The head cover assembly of claim 6, wherein the valve plate is a die cast aluminum alloy.

9. The head cover assembly of claim 6, wherein each plate section includes a pair of valves.

10. A head cover assembly for a pump having at least two separate cylinders, the assembly comprising:

a plate section for each of the cylinders, the plate sections being formed together in a single piece of continuous material;

wherein each plate section includes a pair of valves.

11. The head cover assembly of claim 10, wherein each plate section includes a continuous side wall extending substantially perpendicular around the perimeter of the valve place and a divider wall extending substantially perpendicular from the plate section and spanning the side wall providing an intake chamber and an exhaust chamber.

12. The head cover assembly of claim 11, further comprising a head for each plate section.

13. The head cover assembly of claim 12, further comprising a gasket for sealing each head to the top of the side wall and divider wall.

14. The head cover assembly of claim 12 further comprising a plurality of fasteners to attach the plate sections and heads to the pump.

15. The head cover assembly of claim 11 further comprising a first tube fluidly connecting the intake chambers of the plate sections and a second tube fluidly connecting the exhaust chambers of the plate sections.

16. The head cover assembly of claim 10, further comprising a gasket for sealing each plate section to the corresponding cylinder.

17. A pump, comprising:

at least two cylinder housings; and a head cover assembly comprising a one-piece valve plate including a plate section for each of said cylinder housings, said valve plate including a portion which fluidly connects the plate sections; and at least one head for the valve plate.

18. A pump comprising:

at least two housings, each housing defining a cylinder;

a pair of pistons, each piston being reciprocable in a corresponding one of the cylinders;

a one piece valve plate including a plate section for each of the cylinder housings, said valve plate including a portion which fluidly connects the two plate sections; and at least a pair of heads for the valve plate.

19. The pump of claim 18, wherein the valve plate includes with each plate section a chamber portion having an intake volume and an exhaust volume.

20. The pump of claim 19, wherein the valve plate includes a divider wall between the intake volume and the exhaust volume.

21. The pump of claim 20, wherein the divider wall is straight.

22. The pump of claim 18, wherein each plate section includes a pair of valves.

* * * * *